US007810498B1

(12) United States Patent
Patterson

(10) Patent No.: US 7,810,498 B1
(45) Date of Patent: Oct. 12, 2010

(54) VOLUME EXPANSION SYSTEM FOR BREATHING GAS IN CLOSED-CIRCUIT BREATHING APPARATUS

(75) Inventor: Charles Patterson, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 797 days.

(21) Appl. No.: 11/729,087

(22) Filed: Mar. 23, 2007

(51) Int. Cl.
*A62B 7/02* (2006.01)
*B63C 11/02* (2006.01)

(52) U.S. Cl. ..... 128/204.29; 128/200.24; 128/205.13; 128/205.16; 128/205.24

(58) Field of Classification Search ..... 128/200.24, 128/205.13–205.17, 200.29, 203.28, 204.26, 128/204.28, 204.29
See application file for complete search history.

(56) References Cited

U.S. PATENT DOCUMENTS 4,176,663 A * 12/1979 Hewlett ..... 128/204.26
4,454,878 A * 6/1984 Morrison ..... 128/201.27
4,597,387 A * 7/1986 Carnegie et al. ..... 128/201.27
4,898,166 A * 2/1990 Rose et al. ..... 128/205.13
5,711,296 A * 1/1998 Kolobow ..... 128/205.13
6,408,847 B1 * 6/2002 Nuckols et al. ..... 128/204.18
2002/0073999 A1 * 6/2002 Kellon ..... 128/204.28

* cited by examiner

*Primary Examiner*—Justine R Yu
*Assistant Examiner*—LaToya Louis
(74) *Attorney, Agent, or Firm*—James T. Shepherd

(57) ABSTRACT

A volume expansion system increases the storage volume for breathing gas in a closed-circuit breathing gas apparatus. A flow controller is coupled to an inhalation side of the closed-circuit breathing gas apparatus and is also coupled to an expandable reservoir. The flow controller defines a first flow path that allows breathing gas in the inhalation side to automatically flow into the expandable reservoir when pressure in the inhalation side exceeds a threshold. The flow controller can also include the means to define a second flow path that allows on-demand return of the breathing gas in the expandable reservoir to the inhalation side of the breathing gas apparatus.

7 Claims, 1 Drawing Sheet

VOLUME EXPANSION SYSTEM FOR BREATHING GAS IN CLOSED-CIRCUIT BREATHING APPARATUS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to closed-circuit breathing apparatus, and more particularly to a volume expansion system for the breathing gas in a closed-circuit breathing apparatus.

BACKGROUND OF THE INVENTION

The breathing gas in a diver's closed-circuit breathing gas apparatus (or "re-breather" as they are also known) undergoes volume expansion as a diver ascends through a water column. As a result, there is an increase in pressure at the inhalation side of the breathing gas apparatus that makes it difficult for the diver to exhale. When the diver inhales during a time of increased breathing gas pressure, the breathing gas is forced into the lungs thereby increasing the risk of the very dangerous condition known as pulmonary over inflation syndrome. To address this problem, the diver can bleed off some breathing gas. However, by bleeding off breathing gas, a diver reduces the possible duration of a dive via a reduction in the amount of breathing gas. Another option is for the diver to wait at certain depths during an ascent until enough of the breathing gas is metabolized into carbon dioxide that is then absorbed by a material (e.g., sodalime). This reduces the volume of gas in the rig thereby reducing breathing gas pressure. However, this approach takes extra time.

SUMMARY OF THE INVENTION

Accordingly, it is an object of the present invention to provide a system that accommodates an expanding volume of breathing gas in a closed-circuit breathing gas apparatus.

Another object of the present invention is to provide for the storage of breathing gas in a closed-circuit breathing apparatus as the breathing gas expands and to provide for the subsequent use of the breathing gas so-stored.

Other objects and advantages of the present invention will become more obvious hereinafter in the specification and drawings.

In accordance with the present invention, a system is provided for increasing the storage volume for breathing gas in a closed-circuit breathing gas apparatus. A flow controller is coupled to an inhalation side of the closed-circuit breathing gas apparatus and is also coupled to an expandable reservoir. The flow controller defines a first flow path that allows breathing gas in the inhalation aide to automatically flow into the expandable reservoir when pressure in the inhalation side exceeds a threshold. If the breathing gas stored in the expandable reservoir is to be reused, the flow controller can include the means to define a second flow path that allows on-demand return of the breathing gas in the expandable reservoir to the inhalation side.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
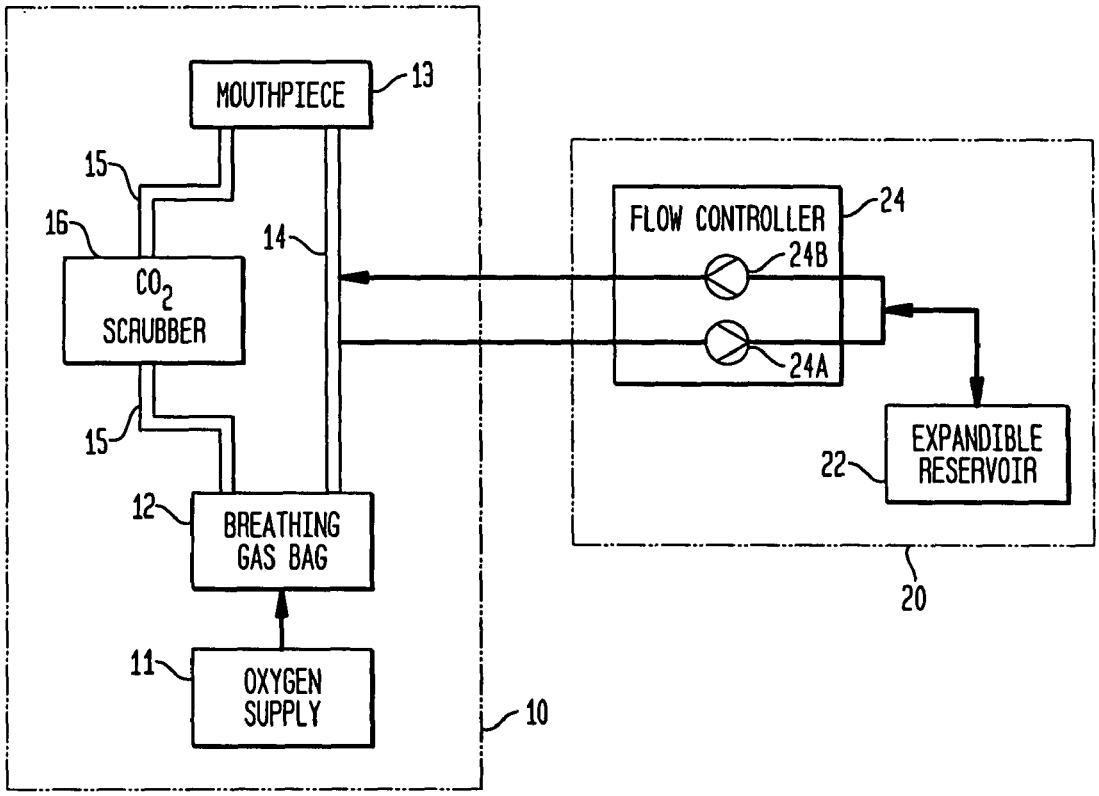
FIG. 1 is a schematic view of a conventional closed-circuit breathing gas apparatus equipped with a volume expansion system for the breathing gas in accordance with the present invention.

Referring now to the drawings and more particularly to FIG. 1, the essential elements of a conventional closed-circuit breathing gas apparatus are illustrated along with the breathing gas volume expansion system of the present invention. The closed-circuit breathing gas apparatus elements are contained within dashed line box 10 and the volume expansion system elements are contained within line box 20.

As is well known in the art, closed-circuit breathing gas apparatus 10 essentially includes an oxygen supply 11, a flexible breathing gas bag 12, a mouthpiece 13, an inhalation line 14 coupled between bag 12 and mouthpiece 13, an exhalation line 15 coupled between bag 12 and mouthpiece 13, and a carbon dioxide ("$CO_2$") scrubber 16 in exhalation line 15. Briefly, oxygen from supply 11 is supplied to bag 12. A diver inhales via mouthpiece 13 and is supplied with oxygen from bag 12 via inhalation line 14. A diver exhales through mouthpiece 13 with the exhalation gas being directed into and through exhalation line 15/$CO_2$ scrubber 16. The carbon dioxide gas is removed with the treated gas being returned to bag 12. Due to the closed-circuit nature of apparatus 10, volume expansion of the breathing gas experienced during an ascent causes an increase in the pressure of the breathing gas.

In accordance with the present invention, volume expansion system 20 provides extra volume that is automatically made available for the storage of breathing gas as breathing gas apparatus 10 ascends through a water column. Volume expansion system 20 is coupled to the inhalation side (e.g., inhalation line 14) of apparatus 10 and includes an expandable reservoir 22 and a flow controller 24. In general, flow controller 24 senses the pressure on the inhalation side of breathing gas apparatus 10 and automatically opens/defines a flow path from the inhalation side to expandable reservoir 22 when the pressure on the inhalation side of apparatus 10 exceeds a prescribed value or threshold. When this occurs, breathing gas in apparatus 10 is available for breathing and allowed to flow into expandable reservoir 22. The increased volume for the breathing gas provided by expandable reservoir 22 reduces the pressure of the breathing gas in apparatus 10. The mechanism for achieving this can be a simple one-way check valve 24A mounted in a line coupling inhalation line 14 and expandable reservoir 22.

If it is desired to allow a diver to use the breathing gas so-stored in expandable reservoir 22, flow controller 24 can optionally include the means to open/define a second flow path from expandable reservoir 22 back to inhalation line 14. The mechanism for achieving this could also be a simple one-way check valve 24B mounted in a line coupling inhalation line 14 to expandable reservoir 22. The opening/closing of check valve 24B could be a manually or automatically-controlled operation without departing from the scope of the present invention.

Figure 2:
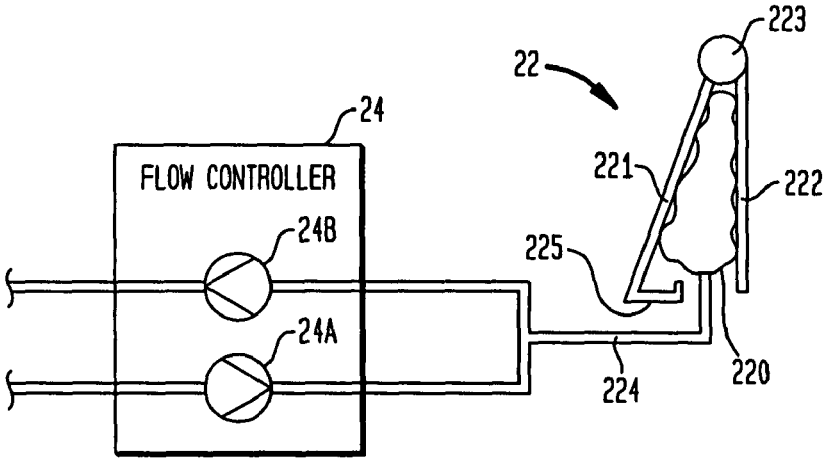
FIG. 2 is a side view of an embodiment of an expandable reservoir for use in the volume expansion system.

Referring now to FIG. 2, an embodiment of expandable reservoir 22 is illustrated. A flaccid (i.e., collapsible) bladder 220 is mounted between two rigid panels or plates 221 and 222 for protection of bladder 220. Bladder 220 can be attached to plates 221 and 222 or can be loosely fitted there between. The particular shape, size or materials used to fabricate panels 221 and 222 are not limitations of the present invention. Plates 221 and 222 are coupled to one another in a hinged fashion along adjoining edges thereof by a hinge 223. The design of hinge 223 and/or the number thereof are not limitations of the present invention. For example, hinge 223 could be spring-loaded such that it biased plates 221 and 222 toward one another. A conduit 224 leads from bladder 220 to flow controller 24. Although not required, expandable reservoir 22 could further incorporate a latch 225 used to lock plate 221 to plate 222 when bladder 220 is collapsed.

In operation, when a diver ascends through a water column, latch 225 would be released so that plates 221 and 222 can pivot about hinge 223. As the diver ascends and the breathing gas expands, flow controller 24 opens a flow path to bladder 220 so that breathing gas can flow into bladder 220 via conduit 224. If the diver was then to again descend and wanted to use the breathing gas stored in bladder 220, he would simply squeeze plates 221 and 222 together. This will pressurize the breathing gas in bladder 220 until it overcomes the threshold setting of check valve 24B. Thus, this embodiment of expandable reservoir 22 allows a diver to access the breathing gas stored in bladder 220 in an "on-demand" fashion.

The advantages of the present invention are numerous. The inherent increase in breathing gas pressure associated with diver ascent is accommodated with a simple and automatic system. The system will make breathing during an ascent easier and safer. Breathing gas is conserved while ascent time requirements and the risk of contracting a pulmonary diving illness are reduced.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A system for increasing the storage volume for breathing gas in a closed-circuit breathing gas apparatus used by a diver during an underwater dive, comprising:

a first pressure-sensitive valve having first and second sides with said first side thereof adapted to be coupled directly to an inhalation line carrying breathing gas from a gas source to a diver's mouthpiece in a closed-circuit breathing gas apparatus, said first pressure-sensitive valve opening when a pressure in the inhalation line exceeds a threshold as the diver ascends through the water wherein the breathing gas is simultaneously (i) provided to the mouthpiece from the gas source through the inhalation line, and (ii) passed through said first pressure-sensitive valve to said second side thereof;

an expandable reservoir coupled to said second side of said first pressure-sensitive valve; and a second pressure-sensitive valve having first and second sides with said first side thereof adapted to be coupled directly to the inhalation line and said second side thereof coupled to said expandable reservoir, said second pressure-sensitive valve opening when pressure in said expandable reservoir exceeds a second threshold as the diver descends through the water wherein the breathing gas is simultaneously provided to the mouthpiece from (i) the gas source through the inhalation line, and (ii) said expandable reservoir.

2. A system as in claim 1 wherein said expandable reservoir comprises:

a collapsible bladder;

first and second plates disposed on either side of said bladder; and means for coupling said first plate to said second plate, and for allowing said first and second plates to move away from one another when said bladder expands.

3. A system as in claim 2 wherein said means for coupling said first plate to said second plate is spring-loaded.

4. A system as in claim 2 further comprising latch means for coupling said first plate to said second plate when said bladder is collapsed.

5. A system for increasing the storage volume for breathing gas in a closed-circuit breathing gas apparatus used by a diver during an underwater dive, comprising:

a bladder;

a flow controller adapted to be coupled directly to an inhalation line carrying breathing gas from a gas source to a diver's mouthpiece in a closed-circuit breathing gas apparatus, said flow controller being coupled to said bladder, said flow controller defining a first flow path that allows breathing gas in the inhalation line to flow to the mouthpiece and simultaneously be directed into said bladder when pressure in the inhalation line exceeds a threshold as the diver ascends through the water, and said flow controller defining a second flow path that allows on-demand return of the breathing gas in said bladder to the inhalation line when the diver descends in the water, wherein the breathing gas is simultaneously provided to the mouthpiece from the gas source and from said bladder;

first and second rigid plates disposed on either side of said bladder; and hinge means for hingedly coupling said first plate to said second plate, wherein said first and second plates pivot about said hinge means to move away from one another when said bladder expands.

6. A system as in claim 5 wherein said hinge means biases said first plate towards said second plate.

7. A system as in claim 5 further comprising latch means for coupling said first plate to said second plate when said bladder is collapsed.

* * * * *